US005192384A

United States Patent [19]

Barrier et al.

[11] Patent Number: 5,192,384

[45] Date of Patent: Mar. 9, 1993

[54] METHODS FOR FORMING COMPOSITE TUBING HAVING TAPERED ENDS

[75] Inventors: James M. Barrier, Anaheim Hills; Mark D. Drey, Murrieta; Leslie V. Montford, Pleasanton; Stephen S. Tan, Albany, all of Calif.

[73] Assignee: Kaiser Aerospace and Electronics Corporation, Foster City, Calif.

[21] Appl. No.: 707,560

[22] Filed: May 30, 1991

[51] Int. Cl.[5] ..... B31C 13/00; B65H 81/00

[52] U.S. Cl. ..... 156/189; 156/190; 156/191; 156/194; 156/425; 264/258; 264/314; 249/184

[58] Field of Search ..... 264/314, 258; 156/161, 156/155, 184, 194, 425, 173, 175, 169, 164, 189, 190, 191; 249/184, 186

[56] References Cited

U.S. PATENT DOCUMENTS 1,952,399 3/1934 Ward ..... 156/417
2,456,513 12/1948 Johnson .
2,967,796 1/1961 Raffel .
3,258,384 6/1966 Scott .
3,754,717 8/1973 Saidla ..... 156/425 X
3,833,699 9/1974 Stefanka .
4,126,659 11/1978 Blad .
4,233,020 11/1980 Oswald ..... 156/425 X
4,397,048 8/1983 Brown et al. ..... 264/285 X
4,448,628 5/1984 Stott ..... 156/425
4,483,731 11/1984 Döhle et al. ..... 264/314 X
4,591,400 5/1986 Fradenburgh et al. ..... 156/173 X
4,741,873 5/1988 Fischer et al. .
4,837,230 6/1989 Chen et al. .
4,853,172 8/1989 Jacaruso et al. .
4,900,487 2/1990 Lalloz et al. .
4,902,458 2/1990 Trimble .
4,931,247 6/1990 Yeh ..... 264/314
4,963,301 10/1990 Davis et al. ..... 264/29.7
4,983,422 1/1991 Davis et al. .

*Primary Examiner*—Jeff H. Aftergut
*Attorney, Agent, or Firm*—Townsend and Townsend

[57] ABSTRACT

Reinforced composite tubes having integral tapered ends are formed on mandrels which are tapered at each end. Reinforcement fabric is first conformed to the mandrel with at least one end of the fabric structure retaining an opening therein. The mandrel is disassembled and removed through the opening, and a matrix cured within the fabric to produce the desired composite. Usually, the fabric structure will be cured in an external mold with an inflatable mandrel inserted through the opening applying internal pressure.

19 Claims, 4 Drawing Sheets

METHODS FOR FORMING COMPOSITE TUBING HAVING TAPERED ENDS

BACKGROUND OF THE INVENTION

1. Field of the Invention

The present invention relates generally to composite tubing and methods for fabricating composite tube structures having integrally-formed tapered ends. More particularly, the present invention relates to a method for fabricating composite tubes having clevis connectors at one or both ends.

Reinforced composite tubing is useful for many purposes including the construction of structural frameworks. Desirably, such structural tubing will possess high tensile and compression strength, even at high and low temperature extremes, as well as high specific strength, rigidity, and modulus. Advanced composites have particularly favorable high strength to density ratios and are especially attractive for space applications, where high strength and low weight are important.

While great progress has been made in the fabrication of the composite tubular members themselves, the strength of any structure formed from the tubes depends ultimately on the ability to make high strength connections between individual tube members. It would be desirable, for example, to provide end connectors on individual tube members which approach or exceed the strength in the remainder of the tube. In particular, it would be desirable to provide tubes which have smooth transitions at each end into various tapered connector configurations, such as clevises tangs, and the like. Such tapered end connectors will tend to uniformly distribute stress into the main portion of the structural member. Moreover, the tapered end regions can be locally reinforced in order to reduce the chance of failure within the transition regions.

The use of composite tubular elements having tapered structural end connectors is described generally in U.S. Pat. No. 4,963,301, assigned to the assignee of the present invention, the disclosure of which is incorporated herein by reference. The composite tubular element which is illustrated in FIG. 3 of the '301 patent incorporates many of the advantages just discussed, but suffers from a region of weakness in the joint or seam which is formed between the primary cylindrical portion 52 and the separately formed tapered end 60. Composite structural members of the type illustrated in the '301 patent would possess superior strength characteristics if they could be formed as an integral structure substantially free from seams and joints.

The manufacturing method described in U.S. Pat. No. 4,963,301, however, does not permit the formation of composite tubular elements which are tapered at both ends. As the composite tubes are formed and cured over a solid mandrel, the tapering of both ends would prevent removal of the mandrel after the tube is finished.

It would therefore be desirable to provide methods for forming reinforced composite tubing elements having integral tapered ends. In particular, it would be desirable to provide methods for forming such tubes over a mandrel and for removing the mandrel prior to curing of the composite matrix material. The method should provide reinforced composite tubing elements having integral end connectors, such as clevises and tangs, where the connectors are formed as continuous extensions of the fabric reinforcement material and the entire tube is substantially seamless and free from joints, junctures, and the like.

2. Description of the Background Art

U.S. Pat. No. 4,963,301 has been described above. U.S. Pat. Nos. 4,983,422; 4,837,230; and 4,741,873, assigned to the assignee of the present invention, each describe methods for forming refractory composite materials which may be employed in forming the composite tubes of the present invention. The disclosures of these three patents are incorporated herein by reference.

U.S. Pat. No. 4,397,048, describes the use of an inflatable mandrel to produce an artificial limb component having an expanded size clevis at one end. U.S. Pat. Nos. 4,126,659; 3,833,699; 3,258,384; and 2,967,796, teach the use of clamshell molds in combination with an inflatable mandrel to produce molded products. U.S. Pat. No. 4,902,458, describes a method for molding hollow bicycle frame components. U.S. Pat. No. 4,900,487, describes a method for molding hollow plastic objects. U.S. Pat. No. 2,456,513, describes a collapsible skeleton structure and a flexible bag for molding processes.

SUMMARY OF THE INVENTION

Reinforced composite tubes having integral tapered ends are formed by conforming a reinforcement fabric over a removable set-up mandrel having a first tapered end and a second tapered end, wherein said tapered ends define build-up areas. A hollow fabric structure is thus formed having first and second tapered ends which correspond generally to those on the mandrel and an opening in at least one of the tapered ends which is smaller than the non-tapered periphery of the mandrel. The mandrel can be removed from the interior of the fabric structure by disassembling the mandrel into a plurality of pieces which individually can fit through the opening, typically by first removing a central portion of the mandrel which lies within the opening and thereafter removing additional portions which are individually sized smaller than the opening. After the interior of the fabric structure is emptied, a matrix precursor material present or introduced into the fabric is cured to form the desired composite composition. Preferably, the matrix is cured by introducing a second, inflatable mandrel through the opening into the hollow interior and placing the fabric structure in an exterior mold cavity. The mandrel is then inflated and the composite material cured under heat and pressure as appropriate for the particular materials involved. Optionally, the cured matrix may be converted into a ceramic or carbon material, typically by pyrolysis.

Thus, improved reinforced composite tubes may be produced which are tapered at each end and include end connectors, such as clevises and tangs, which are formed as continuous extensions of the fabric material. The improved composite tubes are further characterized as being substantially seamless and free from joints and junctures.

DESCRIPTION OF THE SPECIFIC EMBODIMENTS

Figure 1:
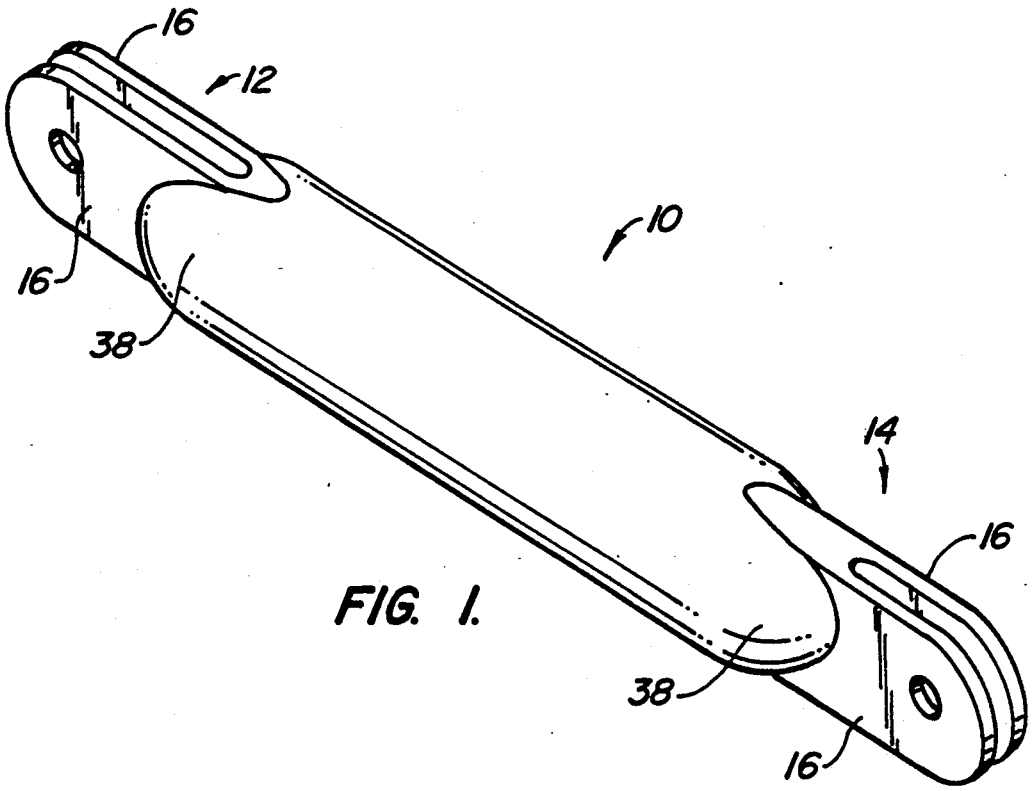
FIG. 1 is a perspective view of a reinforced composite tube fabricated in accordance with the present invention.

According to the present invention, reinforced composite tubes having tapered ends and an opening at at least one of said tapered ends are formed on a rigid or semi-rigid set-up mandrel which generally defines the desired final geometry of the tube. In particular, a reinforcement fabric is conformed over the exterior of the mandrel, typically by rolling or manual lay-up and the mandrel is disassembled and removed through the opening prior to curing. A matrix precursor material present or introduced into the fabric is then cured, typically by inserting an inflatable mandrel into the interior of the hollow fabric structure and placing the fabric structure in an external mold. By then inflating the inflatable mandrel, the impregnated reinforcement fabric is forced against the external mold to finally define the shape of the reinforced composite tube. Optionally, subsequent densification steps may be carried out.

The resulting composite tubes will be elongate structures having integrally formed tapered ends which can be used as anchors in connecting the tubes to each other as well as other structures. Usually, at least one of the tapered ends will be in the form of a clevis having an opening between a pair of opposed tangs which form the clevis. The other end may be a similar clevis structure, a flat tab or tang without an opening, or may be in virtually any other open or closed form. The method of the present invention, however, is particularly suitable for forming reinforced composite tubular structures having interiors which are generally larger than any access holes through the wall of the tube.

The reinforced composite tubes of the present invention are formed from relatively flexible reinforcement fabrics prepared by conventional two-dimensional weaving techniques, such as plain, basket, or harness weaving techniques. The fabrics are usually formed in continuous sheets having a width sufficient to extend the entire length of the tube which is to be formed. The length will be sufficient to provide the desired number of plies as the fabric is laid-up or rolled, as described hereinafter. In some cases, it may be necessary or desirable to employ two or more separate sheets but usually only one continuous sheet will be employed. The sheets will generally comprise a single ply of material, but may in certain cases employ two or more plies formed into a single fabric sheet.

The fabric sheets are formed from woven reinforcement strands, including both individual fibers and bundles of fibers (yarns), where the dimensions and tensile strength of the reinforcement strands will vary depending on the desired strength of the tube and the nature of the material employed. Typically, monofilaments will have a diameter in the range from about 1 to 150 μm, usually in the range from about 5 to 10 μm, while yarns will be comprised of a plurality of individual monofilaments, typically including from about 100 to 20,000 monofilaments, usually comprising from at least about 3,000 to 6,000 monofilaments, where each monofilament has a diameter in the range from about 1 to 20 μm. The denier of both the monofilaments and the yarns used in the reinforcement fabric will typically be in the range from about 500 to 5,000 mg/m, usually being in the range from about 1,000 to 2,000 mg/m.

Suitable reinforcement materials will usually be composed of inorganic filaments, including ceramics, carbon and graphite, glass, and aramid materials. Suitable ceramic materials include silicon carbide, alumina, silicon nitride, boron/tungsten, boron carbide, boron nitride, and zirconia filaments and yarns available from commercial suppliers such as Dow-Corning, Midland, Mich.; AVCO Specialty Materials Division, Lowell, Mass.; and the 3M Company, Minneapolis, Minn. Carbon and graphite filaments and yarns are available from Hercules, Inc., Wilmington, Del.; Celanese Engineering, Chatham, N.J.; Union Carbide Corporation, Specialty Polymers and Composites Division, Danbury, Conn.; and Hitco, Gardena, Calif. Suitable glass filaments and yarns include fused silica, "C" glass, "D" glass, "E" glass, "M" glass, "S" glass, X2285, X2124, VARL 344, VARL 417, and PRD-49, available from a wide variety of commercial suppliers, including DuPont, Wilmington, Del.; Owens-Corning Fiberglass Corp., Toledo, Ohio; and PPG Industries, Pittsburg, Pa. Aramid filaments and yarns are available commercially from suppliers such as DuPont de Nemours, Wilmington, Del., under the trade name KEVLAR fibers.

The reinforcement fabrics will usually be composed of a single-type of reinforcement material, although in some cases it may be desirable to employ two or more different materials. Similarly, individual yarns in the reinforcement fabric may be composed of two or more filament materials when it is desired to combine the characteristics of the various materials.

Optionally, the individual reinforcement strands of the reinforced fabric may be served with a thermoplastic thread, which may itself be a monofilament or multifilament bundle (yarn), as described in U.S. Pat. No. 4,741,873, previously incorporated herein by reference. The thermoplastic serving can melt during the initial lay-up and rolling operations described hereinafter, and solidify to produce interyarn and interply bonding, forming a rigid structure which will retain the desired geometry during subsequent densification operations, incorporating silicon carbide, silicon nitride, and the like.

The reinforced composite tubes of the present invention will preferably be formed with liquid matrix precursors to form carbon and ceramic matrices. Carbon or graphite matrices will be formed using suitable liquid organic precursors, including phenolic resins, epoxies, polyesters, polyamides, polyimides, furfuraldehydes, liquid pitch, and most other thermoplastic and thermosetting resins. Suitable ceramic precursors include silicones and organo-metallic precursors, including polycarbosilanes, liquid aluminum oxide (alumina) precursors, and polysilazanes. These materials may serve as a pre-impregnant as well as the impregnant used for densification as described hereinafter.

After weaving the reinforcement fabric in a conventional manner, liquid matrix precursor will usually be applied to the fabric, typically by spraying, dipping, or spreading, and optionally, the precursor may be partially cured prior to rolling or laying the fabric on a mandrel. Fabric formed from served reinforcement strands may not require such pre-impregnation.

The served and/or pre-impregnated reinforcement fabric will be conformed over a mandrel in order to properly size the material prior to curing. The shape of the mandrel is not critical and its cross-sectional geometry need not necessarily correspond to that of the final reinforced tubular element. The length will generally be slightly longer than the desired length of the tubular element, and the mandrel will be formed in a plurality of pieces so that it can be disassembled and removed piece-by-piece from the interior of the tubular element after the fabric has been conformed and set up.

The set-up mandrel will be sufficiently rigid to maintain its shape during the roll-up or manual lay-up procedures, as described hereinafter. The pieces from which the mandrel is formed can be solid, hollow, or otherwise built up, and in some cases may be collapsible in order to facilitate removal. Usually, the mandrel will include a central member which extends the entire length of the tubular element which is being fabricated, typically extending through and maintaining the opening(s) while the reinforcement fabric is being applied. In this way, the central element may be the first element removed, followed by outer elements which are used to build-out the mandrel.

The mandrel can be formed from a wide variety of materials, including metals, plastics, rubbers, composites, and the like, and need not be formed from a single material. Frequently, different elements or portions of the mandrel will be formed from different materials. Preferred materials include rubbers and plastics.

The reinforcement fabrics may be conformed to the set-up mandrels by any conventional technique used in the fabrication of reinforced composite tubes. Preferred techniques include manual lay-up where the fabric is manually wrapped about the mandrel. Alternatively, the fabric can be rolled onto the mandrel using opposed rollers and bars as illustrated in U.S. Pat. No. 4,963,301, the disclosure of which was previously incorporated herein by reference. The use of such roller systems allows a controlled tension, typically from about 1 to 10 lb/in of width, to be applied on the fabric as it is rolled on the mandrel. If desired, heat can also be applied at one or more locations by heating one or more of the rollers that are being used.

After the fabrics are layed-up or rolled onto the mandrel, it is necessary to conform the ends of the fabric onto the tapered ends of the mandrels. This can be done manually with excess fabric material being trimmed. Optionally, additional layers of reinforcement fabric may be added onto the transition regions between the main body portion of the tube and the end portion(s).

Curing of the formed reinforcement fabric is carried out at elevated temperatures, typically in the range from about ambient temperature to 950° F., depending on the nature of the reinforcement fabric and the impregnant. Usually, curing is performed under pressure by placing an inflatable mandrel into the interior of the tube structure through the opening. The tube structure is placed in an external mold, such as a clam shell mold, and pressure is applied by inflating the inflatable mandrel which presses against the interior of the tube structure. Usually, the inflation pressure will be in the range from about 5 to 500 psig, more typically being in the range from about 50 to 150 psig. Conveniently, curing may be carried out by heating the clamshell mold, either using heaters within the mold or placing the mold in an oven or autoclave. Such curing will be performed for a period of time from about 5 minutes to 24 hours, more usually from about 2 hours to 5 hours.

Specific methods for curing polycarbosilane impregnants and liquid aluminum oxide precursor impregnants are set forth in U.S. Pat. Nos. 4,837,230 and 4,983,422, respectively. The disclosures of each of these patents has previously been incorporated herein by reference.

After the tube structures have been cured, the matrix material can be converted into carbon or ceramics, typically by pyrolysis at an elevated temperature, usually in the range from about 400° F. to 4500° F. Particular methods for curing the polycarbosilane precursors and the aluminum oxide precursors are set forth in the above-referenced patent. Liquid organic precursors may be converted to carbon by pyrolysis at temperatures in the range from about 500° F. to 1500° F., typically for periods from about one hour to 21 days.

Figure 2:
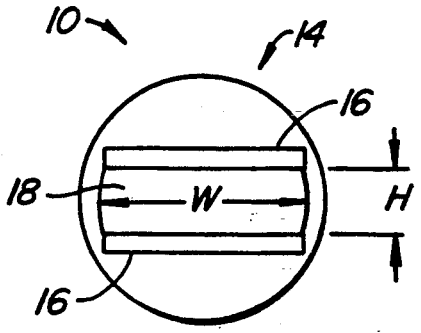
FIG. 2 is an end view of the composite tube of FIG. 1.

Referring now to FIGS. 1 and 2, a reinforced composite tube 10 formed according to the method of the present invention is illustrated. The tube 10 includes a first clevis end 12 and a second clevis end 14, with each clevis including a pair of opposed tangs 16 is best viewed in FIG. 2 which shows an opening 18 formed between tangs 16 and clevis end 14. Usually (although not necessarily) a similar opening will be formed between tangs 16 at clevis end 12.

Figure 3:
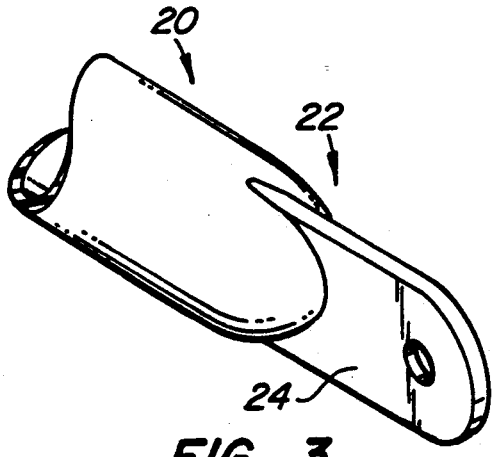
FIG. 3 is an alternate end construction for the reinforced composite tube of FIG. 1.
Figure 4:
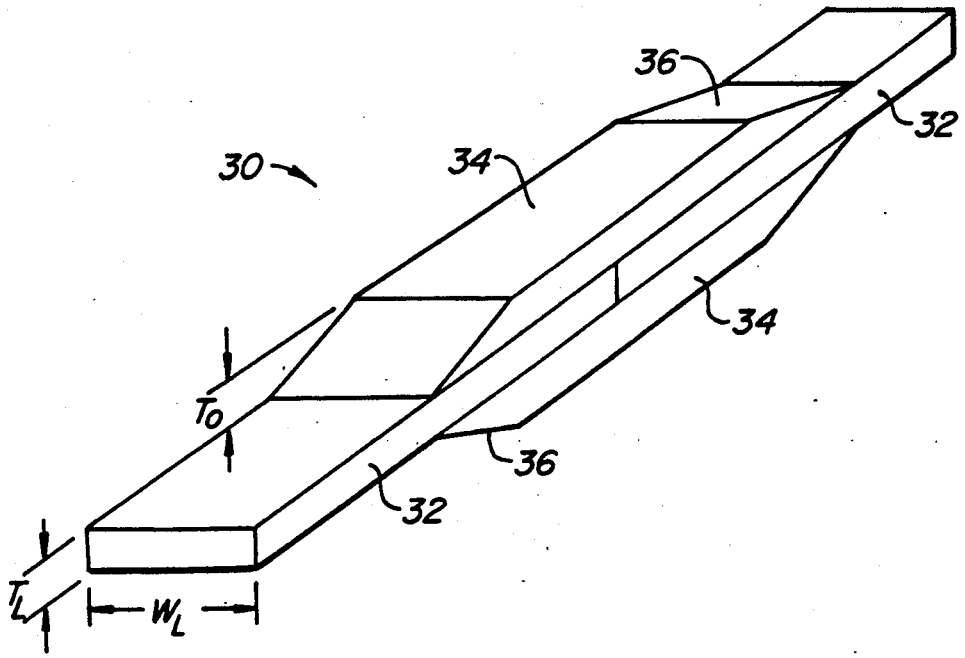
FIG. 4 is a set-up mandrel useful for manual lay-up of the reinforced composite tube of FIG. 1.

Referring now to FIG. 3, a reinforced composite tube 20 can have a closed end 22 which may terminate in a single tang 24 and not include any openings. The other end of the tube 20, of course, will have to have an opening to permit disassembly and withdrawal of the set-up mandrel and optional insertion of an inflatable mandrel, as described above.

When the reinforced tube 10 is manufactured by hand lay-up, a rectangular set-up mandrel 30 may be used to provide the basic dimensions of the tube. The mandrel 30 includes two center pieces 32 which are butted together so that their combined length is longer than the length of the tube to be fabricated. The maximum thickness $T_c$ and width $W_c$ of the center pieces 32 are typically dictated by the height H and width W of the opening 18 (FIG. 2) between the clevis tangs 16. Build-up pieces 34 are added to opposite sides of center pieces 12 to complete the set-up mandrel 34. The width of the build up pieces 34 approximately equals the width of the center pieces. The thickness $T_o$ of the build-up pieces 34 is calculated by the following formula:

$$T_o=[\pi/4](ID_{tube})-[\tfrac{1}{2}](W_c+T_c),$$

where $T_o$=build-up piece thickness;

$W_c$=width of center pieces;

$T_c$=thickness of center pieces; and $ID_{tube}$=inside diameter of tube based upon uncured layer thickness.

If $T_o>T_c$, the build-up pieces will usually be fabricated in two pieces in order to facilitate removal from the clevis end opening. The length of the build-up pieces 34 is dictated by the length of the tube section and the transition area combined. At each end of the build-up pieces 34, a scarf 36 is machined to approximate the shape of the transition area 38 in tube 10 and to allow for extra layers of material added to the clevis end for reinforcement to increase bearing strength.

A light tacking resin is often used to hold the mandrel pieces together during lay-up. After lay-up is complete, the mandrel is disassembled and removed from the fabric roll-up by pulling the center pieces 32 from each end, and then reaching into the interior of the tube and pulling out the build-up pieces 34. This removal process will normally be before curing, and the mandrel will usually be replaced with an inflatable bladder prior to curing. Removal may be done after curing, e.g., when the mandrel is used as an internal mold.

Figure 5:
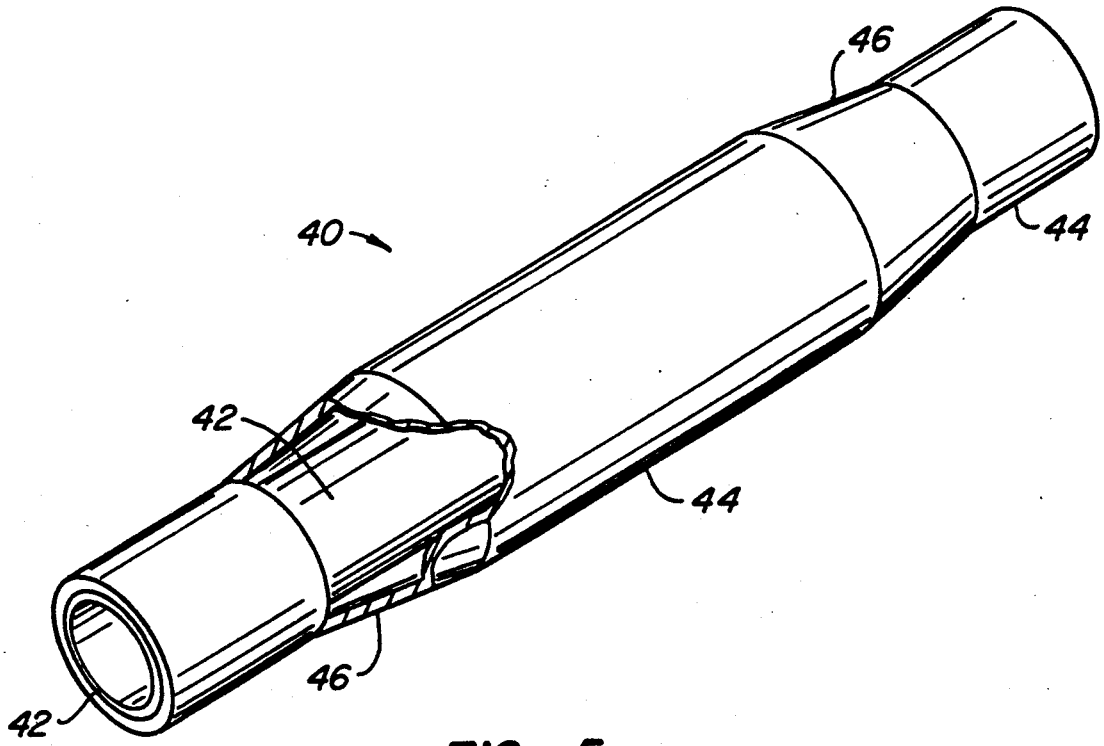
FIG. 5 is a set-up mandrel useful for roll-up of the reinforced composite tube of FIG. 1.

Another method for manufacturing the double clevis tube 10 uses machine rolling of the material onto a removable round cross-section mandrel 40 (see FIG. 5). The mandrel 40 consists of two components: (a) a rigid inner mandrel 42 which has a constant cross-section; and (b) a semi-rigid outer sleeve 44 having the approximate or equivalent shape of the tube inside hollow diameter.

The inner mandrel 42 is fabricated from any material, preferably rigid, and may be solid or hollow in cross-section, depending upon the size of the tube to be fabricated. The outside diameter of the inner mandrel 42 is estimated by converting the perimeter of the rectangle created by the clevis tang opening to a circumference. This is calculated using the following formula:

$$OD_m=[2/\pi](W_t+H_t)-2T_s,$$

where:

$OD_m$=outside diameter of inner mandrel;

$W_t$=width of clevis tang;

$H_t$=height between clevis tang based upon uncured layer thickness; and $T_s$=thickness of outer sleeve at clevis tang region.

The outer sleeve 44 can be fabricated from any semi-rigid material, but the ones that naturally release are preferred. Suitable materials include silicone rubber and Teflon ®. The inside diameter of the sleeve 44 is equal to the outside diameter of the inner mandrel 42, allowing a good fit. The outside diameter of the sleeve at the clevis tang region is calculated using the following formula:

$$OD_s=[2/\pi](W_t+H_t),$$

where $OD_s$=outside diameter of clevis tang region;

$W_t$=width of clevis tang; and $H_t$=height between clevis tangs based upon uncured layer thickness.

The length of the sleeve at the clevis tang region is slightly longer than the clevis tangs.

The outside diameter of the sleeve 44 at the tube portion of the tube is equal to the inside diameter of the hollow tube 10 based upon uncured material thickness. The length of this portion of the sleeve 44 is approximately equal to the tube length.

As with the rectangular mandrel, a taper 46 is formed in the sleeve 44 to approximate the transition area 38 between the main body of the tube 10 and the clevis tangs 16, and also allowing for any extra layers of material added for reinforcement to increase bearing strength. The overall length of the sleeve 44 is normally about equal to the overall length of the inner mandrel.

Where the mandrel serves as an inner mold, the fabric roll-up is treated, as described above, for the rectangular mandrel. If an external mold is used, when roll-up of the uncured part is complete, the inner mandrel 42 is removed from the sleeve 44. Then, sleeve 44 is collapsed by reaching inside with a pair of tweezers or tongs and peeling the sleeve from the wall of the uncured part. The collapsed sleeve 44 is then pulled through the smaller opening 18 at the clevis tang region for removal. An inflatable bladder is then inserted into the fabric structure for curing.

A. Lay-Up Method

Prior to lay-up of the tube 10, material patterns are preferably calculated and cut. There are two types of patterns: (a) full length tube patterns and (b) short build-up layers for creating the clevis end.

1. Full length patterns

The dimension of the full length tube layers are usually calculated as follows:

i) The overall length is slightly longer than the overall length of the tube.

ii) The width of the pattern is calculated using the following formula:

$W=[\pi/2](D_r)_x+2(10T_m)$, where

W=width of pattern;

$[\pi/2](D_r)_x=\frac{1}{2}$ of the circumference of the tube diameter of layer x of the tube laminate; and $2(10T_m)=10$ times the material thickness ($T_m$) to each side of the pattern.

Figure 6A:
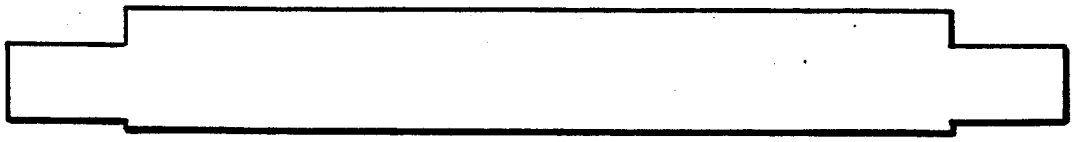
FIGS. 6A–6C illustrate fabric patterns useful for manual lay-up of the reinforced composite tube of FIG. 1.
Figure 6B:
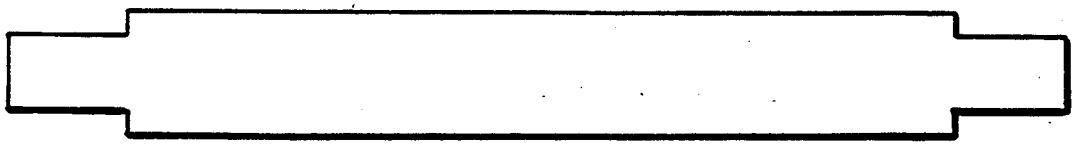
Figure 6C:
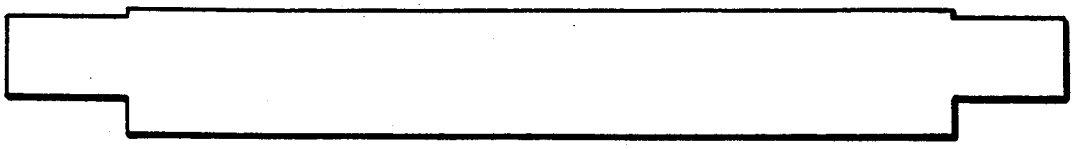

Two or more patterns are generally used to lay-up one full tube layer.

iii) FIGS. 6A–6C show three different configurations of end shapes that will often be cut from the pattern, depending upon the number tube layers. These shapes approximate the shape of the clevis tang and also stagger the seams in tube patterns because the tang sections are stacked on top of each other. Due to the tang sections of two of the patterns being offset, the seams in the patterns are forced to stagger in the tube sections.

Various modified patterns or other patterns may be adapted to this roll-up method.

2. Short build-up layers

The dimensions of the short build-up layers are typically calculated as follows:

i) The length is slightly longer than the sum of lengths of the clevis tang, transition area, and the distance the layer extends into the tube.

ii) The width of the pattern is calculated using the following formula:

$$W=\pi(D_r)_x,$$

where

W=width of the pattern; and $(D_r)_x$=tube diameter at layer x of the laminate.

At least two patterns of this size are usually used per tube (one for each end).

Figure 7:
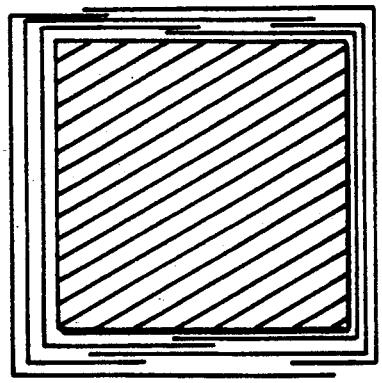
FIG. 7 illustrates exemplary staggering of the fabric layers of FIGS. 6A–6C on the mandrel of FIG. 4.

The specific layer sequence for an individual tube depends upon the design requirements and various modifications will be possible. However, the basic lay-up proceeds as follows:

a. The build-up layers are interspersed between the tube layers. The layers are tacked in place using an appropriate means, e.g., a heat gun or dry iron. There will usually be excess material on the sides of the clevis tang region, which is to be trimmed to eliminate a heavy build-up in this region. Also, any seams of the pattern will optimally be staggered regularly around the lay-up mandrel.

b. The tube layers usually run the full length of the tube. As was mentioned previously, patterns will optimally be designed so the tube seams are automatically staggered. FIG. 7 illustrates how properly selected patterns will have staggered seams when rolled-up on the mandrel.

B. Roll-up Method

Figure 8A:
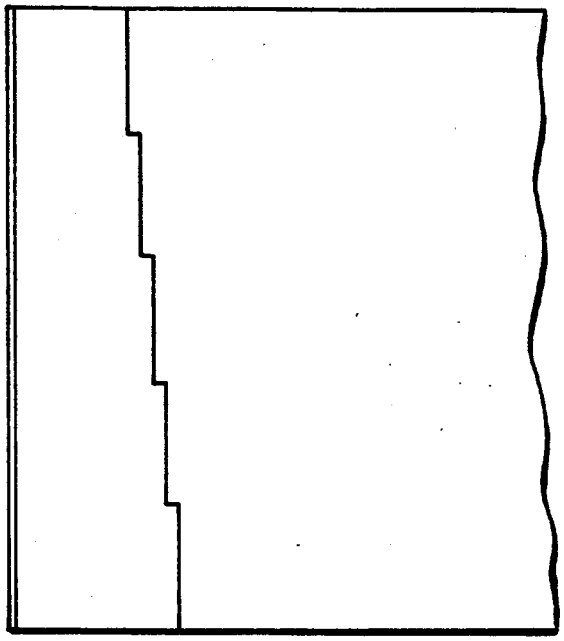
FIGS. 8A–8B illustrate alternative patterns useful for fabric roll-up on the mandrel of FIG. 5 to produce the reinforced composite tube of FIG. 1.
Figure 8B:
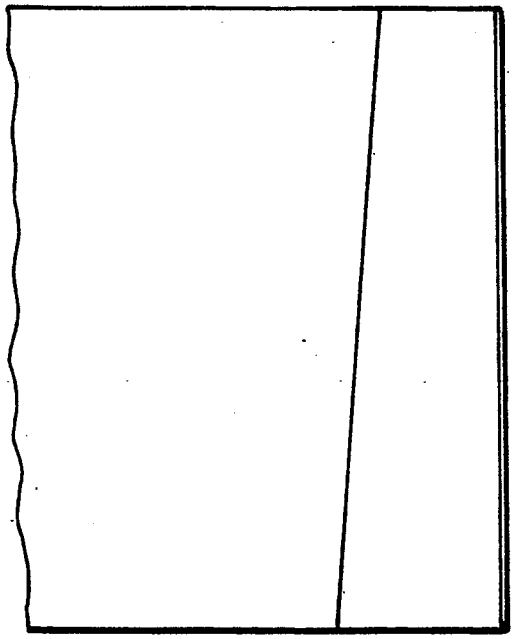

The tube and build-up patterns for the roll-up method differ from the lay-up method. When the tube is rolled, instead of layed-up, the pattern must remain in one piece, or one stack, in order to roll up accurately. FIGS. 8A and 8B show two different pattern types. The tube pattern is basically square or rectangular in shape. The length of the pattern is slightly longer than the length of tube.

The width of the pattern is calculated using the following formula:

$W = N\pi[(ID)_{tube} + (N_{t1})\ T_m]$, where

W = width of the pattern;

N = number of tube layers;

$(ID)_{tube}$ = inside diameter of tube based upon cured layer thickness; and $T_m$ = uncured layer thickness.

There are two types of build-up layer patterns: (a) stepped (FIG. 8A); and (b) tapered (FIG. 8B). The lengths of the patterns are dictated by the design of the tube. The overall width of the pattern is about equal to the width of the tube pattern.

The width of the individual steps for the stepped pattern is calculated by the following formula:

$W_s = \pi(D_r)_x$, where $W_s$ = width of the step;

$(D_r)x$ = diameter of the tube at layer x of the laminate.

The tapered pattern shape is cut by laying a straight edge from the inboard edge of the longest layer to the inboard edge of the shortest layer and trimming the fabric. This gives a gradual tapering of the build-up layers.

Figure 9:
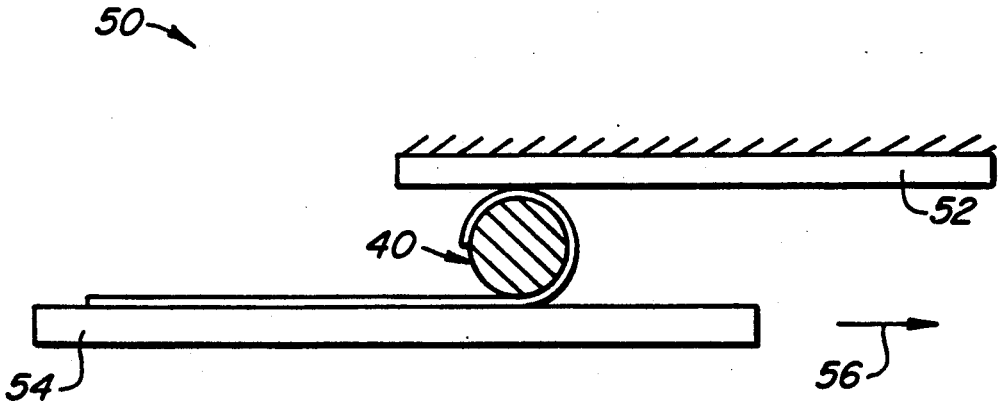
FIG. 9 schematically illustrates a shear wrapper apparatus useful for roll-up onto the mandrel of FIG. 5.

The roll-up method works as follows:

i) The patterns are assembled as shown in FIGS. 8A or 8B.

ii) The patterns assembly is attached to the wrapping mandrel 40.

iii) The mandrel 40 is placed on a shear wrapper 50 whose bed accommodates the contour of the mandrel 40.

iv) A stationary top plate 52 is placed in contact with the mandrel 40 and the bed 54 is moved horizontally, which creates a shearing action between the plate 52 and bed 54 causing the mandrel 40 to turn and roll-up the material (see FIG. 9).

Although the foregoing invention has been described in detail for purposes of clarity of understanding, it will be obvious that certain modifications may be practiced within the scope of the appended claims.

What is claimed is:

1. A method for forming a reinforced composite tube having integral tapered ends, said method comprising:

conforming a fabric over an elongate mandrel, the mandrel having a non-tapered central portion with a first thickness, non-tapered end portions with a second thickness, the first thickness being thicker than the second thickness, and tapered portions between the central portion and end portions tapering from the first thickness to the second thickness, such that the fabric is formed into a hollow fabric structure having first and second tapered ends and an opening in at least one of said fabric structure tapered ends which is smaller than the central portion of the mandrel;

removing the mandrel from the interior of the fabric structure by disassembling the mandrel to fit through the opening;

curing a matrix precursor material in the fabric to form the reinforced composite tube and, forming at least one of the tapered ends in the fabric into a tapered connector configuration.

2. A reinforced composite tube as in claim 1, having a circular or rectangular cross-section between said tapered ends.

3. A method as in claim 1, wherein the fabric is composed of a material selected from the group consisting of graphite, ceramic, glass, and aramid.

4. A method as in claim 2, wherein the fabric is preimpregnated with a partially-cured matrix.

5. A method as in claim 2, wherein the fabric is preimpregnated with an organic matrix precursor selected from the group consisting of liquid organic precursors, polycarbosilanes, and liquid aluminum oxides.

6. A method as in claim I, wherein the fabric is conformed by rolling onto a cylindrical mandrel having tapered ends.

7. A method as in claim 1, wherein the fabric is conformed by hand lay-up over a rectangular mandrel having tapered ends.

8. The method according to claim 1 wherein the mandrel comprises:

a core member having a first length and a first thickness; and at least one build-up member with tapered ends disposed on said core member in a central portion thereof, the build-up member having a second length shorter than the first length such that ends of the core member extend beyond the tapered ends of the build-up member.

9. a method for forming a reinforced composite tube having integral tapered ends, said method comprising:

conforming a fabric over an elongate mandrel, the mandrel having a non-tapered central portion with a first thickness, non-tapered end portions with a second thickness, the first thickness being thicker than the second thickness, and tapered portions between the central portion and end portions tapering from the first thickness to the second thickness, such that the fabric is formed into a hollow fabric structure having first and second tapered ends and an opening in at least one of said fabric structure tapered ends which is smaller than the central portion of the mandrel;

removing the mandrel from the interior of the fabric structure by disassembling the mandrel to fit through the opening;

introducing an inflatable mandrel into a hollow interior of the fabric structure;

inflating the inflatable mandrel while the fabric structure is held within an external mold having a desired geometry;

curing a matrix in the fabric to form the reinforced composite tube;

and, forming at least one of the tapered ends in the fabric into a tapered connector configuration.

10. A method as in claim 9, wherein the fabric is composed of a material selected from the group consisting of graphite, ceramic, glass, and aramid.

11. A method as in claim 10, wherein the fabric is pre-impregnated with a partially-cured matrix.

12. A method as in claim 11, wherein the fabric is pre-impregnated with an organic matrix precursor selected from the group consisting of liquid organic precursors, polysilazanes, polycarbosilanes, and liquid aluminum oxides.

13. A method as in claim 9, wherein the fabric is conformed by rolling onto a cylindrical mandrel having tapered ends.

14. A method as in claim 9, wherein the fabric is conformed by hand lay-up over a rectangular mandrel having tapered ends.

15. A method as in claim 9, wherein the mandrel is collapsed by first removing a central portion which is disposed through said opening and thereafter removing additional portions which are individually sized smaller than said opening.

16. A method as in claim 15, wherein the elongate mandrel has a rectangular cross-section and the inflatable mandrel has a circular cross-section, wherein the rectangular dimensions are selected to allow the fabric structure to conform to the diameter of the inflatable mandrel.

17. A method as in claim 15, wherein the elongate mandrel has a circular cross-section which corresponds generally to the cross-section of the inflatable mandrel.

18. A method as in claim 9, further comprising machining the tapered ends to form a clevis.

19. The method according to claim 9 wherein the mandrel comprises:

a core member having a first length and a first thickness; and at least one build-up member with tapered ends disposed on said core member in a central portion thereof, the build-up member having a second length shorter than the first length such that ends of the core member extend beyond the tapered ends of the build-up member.

* * * * *